US010724526B2

(12) United States Patent
Lagas

(10) Patent No.: US 10,724,526 B2
(45) Date of Patent: Jul. 28, 2020

(54) MULTI-STAGE HORIZONTAL CENTRIFUGAL PUMP FOR CONVEYING A FLUID AND A METHOD FOR REPAIRING THE SAME

(71) Applicant: Sulzer Management AG, Winterthur (CH)

(72) Inventor: Nicolas Lagas, Leutenheim (FR)

(73) Assignee: SULZER MANAGEMENT AG, Winterthur (CH)

( * ) Notice: Subject to any disclaimer, the term of this patent is extended or adjusted under 35 U.S.C. 154(b) by 511 days.

(21) Appl. No.: 15/381,351

(22) Filed: Dec. 16, 2016

(65) Prior Publication Data

US 2017/0191480 A1 Jul. 6, 2017

(30) Foreign Application Priority Data

Dec. 30, 2015 (EP) ..... 15203126

(51) Int. Cl.
*F04D 1/06* (2006.01)
*F04D 29/047* (2006.01)
(Continued)

(52) U.S. Cl.
CPC ..... *F04D 1/06* (2013.01); *F04D 29/043* (2013.01); *F04D 29/046* (2013.01);
(Continued)

(58) Field of Classification Search
CPC . F04D 1/02; F04D 1/06; F04D 29/043; F04D 29/044; F04D 29/12; F04D 29/126; F04D 29/622; F04D 29/628; F16C 32/067; F16C 25/00
See application file for complete search history.

(56) References Cited

U.S. PATENT DOCUMENTS 3,788,764 A * 1/1974 Shuey ..... F04D 1/06 415/104
6,234,748 B1 * 5/2001 Brown ..... F04D 29/0413 415/170.1
6,884,031 B2 * 4/2005 Gregory ..... F04D 1/063 415/199.2

FOREIGN PATENT DOCUMENTS

CN 201288673 Y 8/2009
CN 202284568 U 6/2012
(Continued)

OTHER PUBLICATIONS

Wolfram Lienau et al: "Evaluation of R0t0rdynamic Criteria for Multistage Pump Shafts", Dec. 31, 2008 (Dec. 31, 2008), URL:http://turbolab.tamu.edu/proc/pumpproc/P24/05-1ienau.pdf (Year: 2008).*
(Continued)

*Primary Examiner* — Brian P Wolcott
(74) *Attorney, Agent, or Firm* — Global IP Counselors, LLP

(57) ABSTRACT

A multi-stage horizontal centrifugal pump for conveying a fluid has a rotor including a rotatably arranged shaft and a plurality of impellers for conveying the fluid and a stator. All the impellers are arranged in a rotatably fixed manner on the shaft. The stator includes a plurality of stage casings, which are arranged consecutively one after another with respect to an axial direction determined by a central axis. The stator encompasses the rotor, and each stage casing is designed and arranged centrically with respect to the central axis. A plurality of wear rings is disposed between the rotor and the stator, each of which is fixed with respect to the stator, and surrounds the rotor with a clearance. At least one of the wear rings is designed eccentrically.

15 Claims, 7 Drawing Sheets

(51) Int. Cl.

| | |
|---|---|
| ***F04D 29/62*** | (2006.01) |
| ***F04D 29/16*** | (2006.01) |
| ***F04D 29/10*** | (2006.01) |
| ***F04D 29/42*** | (2006.01) |
| ***F04D 29/043*** | (2006.01) |
| ***F04D 29/046*** | (2006.01) |
| ***F04D 29/18*** | (2006.01) |
| ***F04D 29/22*** | (2006.01) |
| ***F04D 29/44*** | (2006.01) |

(52) U.S. Cl.

CPC ..... *F04D 29/0473* (2013.01); *F04D 29/106* (2013.01); *F04D 29/167* (2013.01); *F04D 29/185* (2013.01); *F04D 29/22* (2013.01); *F04D 29/426* (2013.01); *F04D 29/4293* (2013.01); *F04D 29/441* (2013.01); *F04D 29/622* (2013.01); *F04D 29/628* (2013.01)

(56) References Cited

FOREIGN PATENT DOCUMENTS

| | | | | |
|---|---|---|---|---|
| CN | 203835734 | U | * | 9/2014 |
| CN | 203835734 | U | | 9/2014 |
| RU | 2005216 | C1 | | 12/1993 |

OTHER PUBLICATIONS

Extended European Search Report dated Jul. 21, 2016 in EP Patent Application No. 15203126.6, filed Dec. 30, 2015 (with English Translation of Categories of Cited Documents).

Wolfram Lienau, et al., "Evaluation of Rotordynamic Criteria for Multistage Pump Shafts", International Pump Users Symposium, XP055287458, Dec. 31, 2008, pp. 35-44.

* cited by examiner

MULTI-STAGE HORIZONTAL CENTRIFUGAL PUMP FOR CONVEYING A FLUID AND A METHOD FOR REPAIRING THE SAME

CROSS-REFERENCE TO RELATED APPLICATION

This application claims benefit to European Application No. 15203126.6, filed Dec. 30, 2015, the contents of which is hereby incorporated herein by reference.

BACKGROUND

Field of the Invention

The invention relates to a multi-stage horizontal centrifugal pump for conveying a fluid, as well as a method for repairing or overhauling a multi-stage horizontal centrifugal pump.

Background of the Invention

Multi-stage horizontal centrifugal pumps are used in many different technological sectors, e.g. in the oil and gas industry or in industrial energy generation. In the latter field, such multi-stage pumps are used e.g. as feed pumps or boiler feed pumps in order to feed water at the required pressure to a steam generator. In such pumps, a plurality of pump stages arranged horizontally next to each other are commonly provided, with each pump stage comprising a stage casing in each of which an impeller is provided which conveys the fluid, e.g. water, from the low-pressure inlet of this pump stage to its high-pressure outlet, which is then connected to the inlet of the next stage. All impellers are arranged in a rotatably fixed manner on a common shaft, which accordingly extends through all stage casings and is driven by a power unit, e.g. an electric motor. The individual pump stages are sealed along the common shaft typically by wear rings, which are arranged or mounted in a stationary, i.e. fixed manner with respect to the stage casings. It is a standard measure that two wear rings are provided for one pump stage, namely a first wear ring on the low-pressure side that surrounds the front cover plate of the impeller, and a second wear ring on the high-pressure side fixed in position to a partition wall which conducts the fluid from the outlet of the stage to the inlet of the next stage and typically comprises a diffuser.

SUMMARY

Each of the wear rings has a certain clearance with respect to the shaft so that an annular gap is formed between the cylindrical barrel-shaped surface of the wear ring positioned radially on the interior and the rotating outer surface of the shaft, such a gap permitting the escape of liquid from the high-pressure side to the low-pressure side. On the one hand this leakage flow is advantageous in that it contributes to the hydrodynamic stabilization of the rotor (shaft with impellers), but on the other hand means a certain reduction in the efficiency of the pump. The dimensioning of this clearance thus takes on considerable importance. It is of course always desired that direct physical contact between the stationary wear rings and the rotating shaft is avoided during the operation of the pump. As their name indicates, the wear rings are wear parts, which must be replaced during the operating life of the pump. This is primarily because the leakage flow leads to erosion effects on the wear rings. Consequently, the gap between the respective wear ring and the shaft expands, resulting in an increase in the leakage flow. As this increase in the leakage flow decreases the efficiency of the pump, the wear rings must normally be replaced by new ones.

One specific problem afflicting multi-stage horizontal centrifugal pumps that occurs particularly with larger numbers of stages is related to the length of the shaft and the mass of the impellers mounted in a rotatably fixed manner on it. The totality of the components that rotate when operating are referred to hereinafter as the "rotor". The rotor thus comprises the shaft and the impellers. In the case of long shafts or rotors, the own mass of the rotor results in a not insignificant degree of deflection to the shaft. This deflection is usually greatest in the central region of the shaft. The centerline of the shaft, which would be a straight line in the absence of deflection, which aligns with the central axis of the pump and with the axis of rotation, becomes a curved line as a result of the deflection, which is referred to herein as the sag line of the shaft or sag line of the rotor. The deviation of the sag line from the central axis of the pump is greatest approximately in the middle between the radial bearings for the shaft. Due to the gravitational force, the sag line in a horizontal pump is a convex function.

The deflection of the shaft is typically greatest during a standstill of the pump. When the shaft rotates, the shaft normally lengthens, i.e. in particular its maximum deflection is reduced. This lengthening is also the consequence in particular of hydrodynamic effects, such as the Lomakin effect.

The problem caused by the deflection of the rotor is the result of the fact that the shaft no longer extends perpendicularly through all pump stages or stage casings, but instead at an angle through at least some stage casings, i.e. at an angle other than 90°, which of course depends on the sag line of the shaft. The clearance between the wear rings and the shaft or cover plate of the impellers must therefore be chosen so as to be sufficiently large that the rotor does not come into physical contact with the wear rings while rotating, despite its deflection. On the other hand—as already mentioned—one does not wish the degree of clearance to be so great as to significantly reduce the efficiency of the pump. Consequently, the clearance is usually set such that, under all normal operating conditions, the rotor just avoids physical contact with the wear rings. However, when the pump is stopped, the deflection of the rotor increases such that, at the latest during standstill of the rotor, it is in physical contact with and rests upon at least some wear rings.

This resting of the rotor on the wear rings during standstill has several disadvantages. Thus, for example, it is no longer possible to manually rotate the rotor during standstill, which is a significant disadvantage during the installation or maintenance of the pump. In addition, when the pump is run up or turned off, at least some of the wear rings grind against the rotor, which on the one hand increases or accelerates the abrasion of the wear rings, and on the other hand decreases the useful life of the shaft or the cover plates of the impellers. While it is possible to protect the wear rings against excessive wear by providing them with an appropriate coating, this makes the production of the wear rings more difficult and more expensive.

Another option for solving this problem would be to significantly increase the clearance between the rotor and the wear rings so that the rotor is also freely rotatable during standstill. For many applications, however, and in particular in industrial energy generation, this solution is not desirable or even acceptable, as this increased clearance necessarily results in a reduction in the efficiency or effectiveness of the pump, which conflicts with the objective of minimizing energy consumption and using resources in an environmentally conscious manner.

It has been suggested in the past as a solution to this problem that the individual stage casings of the pump in the central region of the pump no longer be arranged perpendicularly to the central axis, but to tilt them slightly, i.e. arrange them at an angle, in order to approximately follow the course of the sag line. The totality of the stage casings thus forms at least in the central region of the pump a V-shaped stator structure which approximately follows the sag line of the shaft. Such a solution is disclosed e.g. in the Chinese utility model CN 201288673.

However, this angled or tilted arrangement of the stage casings is complex in its construction. In designs as ring section pumps, in which the totality of the stage casings form the outer pump casing, an adjustment of the rotor setting e.g. is often problematic, as, in general, new stage casings are partially required. Reworking the individual stage casings is often not possible. Additional challenges arise if the pump is designed with a barrel casing (barrel pump), i.e. if the individual stage casings are arranged in a common outer pump casing. In this configuration, it is required to also position the inlet nozzle of the pump casing at an angle, which is very costly and arduous. The installation of the individual stage casings in the outer pump casing is also difficult and arduous due to the angled position of the stage casings relative to the pump casing. Finally, it is also not possible to provide reliable internal seals within the pump casing between the pump casing and a stage casing positioned at an angle relative to it, in order to seal off e.g. different pressure chambers from another within the pump casing.

Starting from this prior art, it is thus one purpose of the invention to provide a multi-stage horizontal pump in which physical contact between the rotor and the wear rings is reliably prevented during all normal operating conditions, and in particular also during standstill of the rotor or shaft, without having to accept a loss of efficiency of the pump. In particular, it should be possible to embody the pump with a long shaft as well. It is a further purpose of the invention to suggest a method for repairing or overhauling a multi-stage horizontal centrifugal pump in order that physical contact between the rotor and the wear rings is reliably avoided in all normal operating conditions, and in particular, also during standstill of the rotor or shaft, without any loss of efficiency of the pump.

The subject matter of the invention which solve these problems are described herein.

In accordance with the invention, then, a multi-stage horizontal centrifugal pump for conveying a fluid is disclosed, having a rotor comprising a rotatably arranged shaft and a plurality of impellers for conveying the fluid, wherein all impellers are arranged in a rotatably fixed manner on the shaft, and having a stator comprising a plurality of stage casings (31), which are arranged consecutively one after another with respect to an axial direction determined by a central axis, wherein the stator encompasses the rotor, and wherein all stage casings are designed and arranged centrically with respect to the central axis (A), and wherein a plurality of wear rings is disposed between the rotor and the stator, each of which is fixed with respect to the stator, and respectively surrounds the rotor with a clearance, and wherein at least one of the wear rings is designed eccentrically, with a rotatably arranged shaft and with a plurality of pump stages, which are arranged consecutively one after another with respect to an axial direction determined by a central axis, wherein each pump stage comprises an impeller for pumping the fluid, wherein the impeller includes a front cover plate, as well as a stage casing with a stationary impeller opening to receive the front cover plate of one of the impellers, and a partition wall for conducting the fluid to the adjacent pump stage, wherein the partition wall is stationary with regard to the stage casing, wherein the impellers of all pump stages are arranged in a rotatably fixed manner on the shaft, wherein each stationary impeller opening is radially inwardly confined by a first wear ring, which surrounds the front cover plate of the impeller with a clearance, and wherein each stationary partition wall is radially inwardly confined by a second wear ring, which surrounds the shaft with a clearance, and wherein at least one of the first or the second wear rings is eccentrically designed.

The term "eccentrically designed" is used with respect to the wear ring to mean that the radially outer surface of the wear ring is centered about a first axis and the radially inner surface of the wear ring about a second axis, wherein the first and the second axis are parallel, but are not congruent.

If an eccentric wear ring is disposed in particular where the deflection of the shaft or rotor is greatest, it can be ensured that, when operating, the shaft or rotor rotates in particular in the region of greatest deflection approximately so as to be centered in the eccentric wear ring, i.e. the rotor is approximately centered with respect to the eccentric wear ring. If the rotor is then stopped, as a result of which its maximum deflection is increased, there remains sufficient clearance in the eccentric wear ring such that, even during standstill of the rotor, physical contact between the rotor and the wear ring is reliably prevented. The shaft or rotor is thus also free during standstill, i.e. is not in contact with the wear ring, and can be rotated e.g. by hand.

A particular advantage of this configuration in accordance with the invention is that the deflection of the shaft can be compensated for using only a very inexpensive component, namely the wear ring, or a plurality of such rings. This also allows in particular a very inexpensive and rapid adjustment to changes to the rotor setting, for at most one or more wear rings must be replaced, but no additional constructional changes need be made in particular to other, significantly more expensive components of the pump, e.g. to one of the stage casings.

Furthermore, due to the eccentric design, it is also not necessary to provide greater clearance between the wear ring and the rotor, thus no reduction in the efficiency of the pump has to be tolerated.

All stage casings are preferably arranged concentrically to the central axis of the pump. This is particularly advantageous from a constructional point of view, as the stage casings for at least almost all pump stages can then be designed essentially identically. As the deflection of the rotor is already compensated for by the eccentric design of the wear ring, it is in particular not necessary to compensate for the deflection of the shaft through constructional measures to the stage casings themselves. For example, an eccentric design of one or more stage casings or other components can be dispensed with.

The number of wear rings for which an eccentric design is preferred of course depends on the specific application intended, and in particular on the length of the shaft, the number of impellers, and the mass of the rotor. For many applications, it is preferable that a plurality of the wear rings be eccentrically designed.

In particular, it is preferable that the eccentricity of the wear rings not be constant along the length of the shaft.

Specifically, it is advantageous if the wear rings increase in eccentricity toward the center of the pump, i.e. that, viewed from one end of the pump, the eccentricity of the wear rings initially increases, reaching a maximum in the region of the center of the pump, i.e. where the deflection of the shaft is usually greatest, then decreasing from that point.

The distance of the first axis about which the radially outer surface of the wear ring is centered from the second axis about which the radially inner surface of the wear ring is centered is taken as a measure of the eccentricity of an individual wear ring.

In one especially preferred embodiment, the eccentricity of the wear rings is adapted to the sag line of the shaft. This means that the greater the distance of the sag line from the central axis of the pump, the greater the eccentricity selected for the wear ring, so that the eccentricity essentially follows the sag line of the shaft. This measure also has the particular advantage that all stage casings can be arranged parallel and perpendicular to the central axis of the pump. An angled arrangement of the stage casings or other components can thus be dispensed with.

A further advantageous measure consists in measuring the eccentricity of all wear rings such that during standstill of the shaft none of the wear rings contacts the shaft or an impeller. As the deflection of the shaft or rotor is greatest during standstill, the radial width of the gap between the wear rings and the rotor (shaft or impeller) can be minimized through this measure. It is also preferable for the eccentricity of all wear rings to be measured such that the sag line of the shaft extends essentially centered with respect to all wear rings at a nominal speed of the pump. The bent shaft is then at least approximately centered with respect to the wear rings as it rotates, i.e. has the same clearance in all radial directions. This is advantageous e.g. particularly for heat-induced changes to the rotor. Thus, in the case of temperature changes e.g. in the medium to be conveyed, significantly greater changes of temperature can be permitted, i.e. higher temperature gradients, without the need for additional measures, such as the preheating of the rotor. This is also advantageous in particular with regard to applications in the field of industrial power generation.

In a preferred embodiment, the pump has a plurality of pump stages, which are arranged consecutively one after another with respect to the axial direction, wherein each pump stage comprises an impeller for pumping the fluid, wherein the impeller is provided with a front cover plate, as well as one of the stage casings and a partition wall for conducting the fluid to the adjacent pump stage, wherein the partition wall is stationary with respect to the stage casing, wherein the stage casing is designed with a stationary impeller opening to receive the front cover plate of one of the impellers, wherein each stationary impeller opening is radially inwardly confined by a first wear ring, which surrounds the front cover plate with a clearance, and wherein each stationary partition wall is radially inwardly confined by a second wear ring, which surrounds the shaft with a clearance.

Here as well, it is advantageous if the eccentricity of all wear rings is measured such that during a standstill of the shaft none of the wear rings is in contact with the shaft or an impeller. As a result, it is possible to further reduce the clearance both between the shaft and the second wear rings and between the front cover plates of the impellers and the first wear rings as compared to known multi-stage pumps, permitting the efficiency of the pump in accordance with the invention to be further increased.

Due to their eccentricity the wear rings have to be inserted at a certain angular orientation with respect to the radial level perpendicular to the central axis to ensure their correct functionality. In principle, this is possible, as the part of the wear ring having the greatest radial width is positioned exactly above the shaft (with respect to the normal, horizontal position), or that part having the smallest radial width is positioned exactly below the shaft. In order to simplify the installation of the wear rings, each eccentric wear ring preferably has a positioning means (device) to position the respective wear ring at a predefined angular orientation in the respective stage casing or the respective partition wall. This positioning device can for example be a visually recognizable marking on the wear ring or a positioning pin which engages into a corresponding hole provided in the stage casing or in the partition wall.

It is particularly preferred that the positioning device is disposed where the respective wear ring has its maximum width in the radial direction, as this allows an especially simple installation of the wear ring.

In a preferred configuration the pump is designed as a barrel casing pump, in which all stage casings are arranged in a barrel casing. As all stage casings are arranged parallel to each other and perpendicularly to the central axis of the pump, the inlet nozzle can be produced in a conventional manner, i.e. as described above, the tilted position of the inlet nozzle which is very problematic can be dispensed with. Furthermore, it is possible to provide reliable seals between the stage casings and the outer barrel casing. Thus, different pressure chambers can disposed within the barrel casing in which the fluid is available at different pressures. This allows, in particular, providing the pump according to the invention with an inlet and an outlet as well as an intermediate outlet for the fluid to be conveyed, with the intermediate outlet being designed and arranged in such a manner that at least a part of the fluid can be discharged at an intermediate pressure through the intermediate outlet, which intermediate pressure is greater than the pressure of the fluid at the inlet of the pump and smaller than the pressure of the fluid at the outlet of the pump. The possibility of discharging the fluid at an intermediate outlet at a pressure other than that at the outlet constitutes a great advantage for many applications.

This invention also suggests a method for repairing or overhauling a multi-stage horizontal centrifugal pump for conveying a fluid with a rotor comprising a rotatably arranged shaft as well as a plurality of impellers for conveying the fluid, wherein all impellers are arranged in a rotatably fixed manner on the shaft, and with a stator comprising a plurality of stage casings, which are arranged consecutively one after another with respect to an axial direction determined by a central axis, wherein the stator encompasses the rotor, and wherein all stage casings are designed and arranged centrically with respect to the central axis, and wherein a plurality of wear rings is disposed between the rotor and the stator, each of which is fixed with respect to the stator and respectively surrounds the rotor with a clearance, in which procedure one or a plurality of the wear rings is replaced, wherein one or a plurality of the wear rings is replaced in each case by an eccentrically designed wear ring.

In particular, the method is also suitable for repairing or overhauling a multi-stage horizontal centrifugal pump for conveying a fluid with a rotatably arranged shaft and a plurality of pump stages, which are arranged consecutively one after another with respect to an axial direction determined by a central axis, wherein each pump stage comprises an impeller for pumping the fluid, wherein the impeller is provided with a front cover plate, as well as a stage casing with a stationary impeller opening to receive the front cover plate of one of the impellers, and a partition wall for conducting the fluid to the adjacent pump stage, wherein the partition wall is stationary with respect to the stage casing, wherein the impellers of all pump stages are arranged in a rotatably fixed manner on the shaft, wherein each stationary impeller opening is radially inwardly confined by a first wear ring surrounding the front cover plate of the impeller with a clearance, and wherein each stationary partition wall is radially inwardly confined by a second wear ring surrounding the shaft with a clearance. In this embodiment of the method according to the invention one or a plurality of the first and/or second wear rings is replaced, wherein one or a plurality of the second wear rings is replaced in each case by an eccentrically designed wear ring.

This method allows maintaining a pump designed in accordance with the invention or to adapt it to another setting of the rotor as well as to overhaul or upgrade a conventional pump without eccentric wear rings in such a manner that its form is then in accordance with the invention. Consequently, this method is particularly suitable for upgrading already existing pumps such that the deflection of the rotor is compensated or better compensated for by one or a plurality of eccentrically designed wear rings. It is particularly advantageous that this upgrade can usually be achieved only by replacing the cost-effective wear rings without modifying any other components of the pump.

For the same reasons as explained above in the case of the pump according to the invention, it is advantageous also with regard to the method,

- if the eccentricity of the wear rings is adjusted to a sag line of the shaft;
- if the eccentricity of each wear ring is measured such that during standstill of the shaft none of the wear rings contacts the shaft, and
- if the eccentricity of each wear ring is measured such that the sag line of the shaft extends essentially centered with respect to all wear rings at a nominal speed of the pump.

Further advantageous measures and configurations of the invention result from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
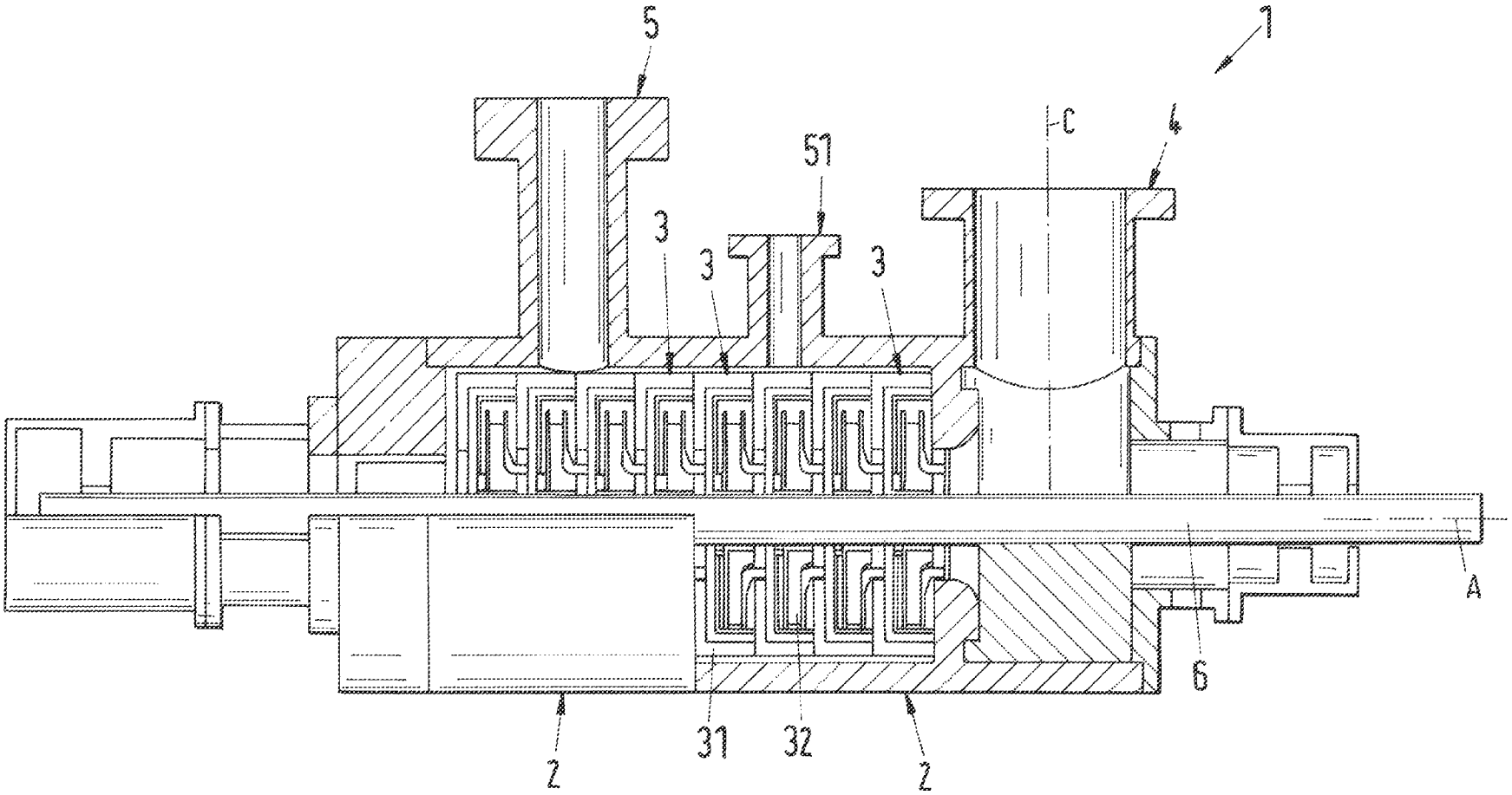
FIG. 1 is a schematic lateral view of an embodiment of a pump according to the invention in partial cross section.
Figure 2:
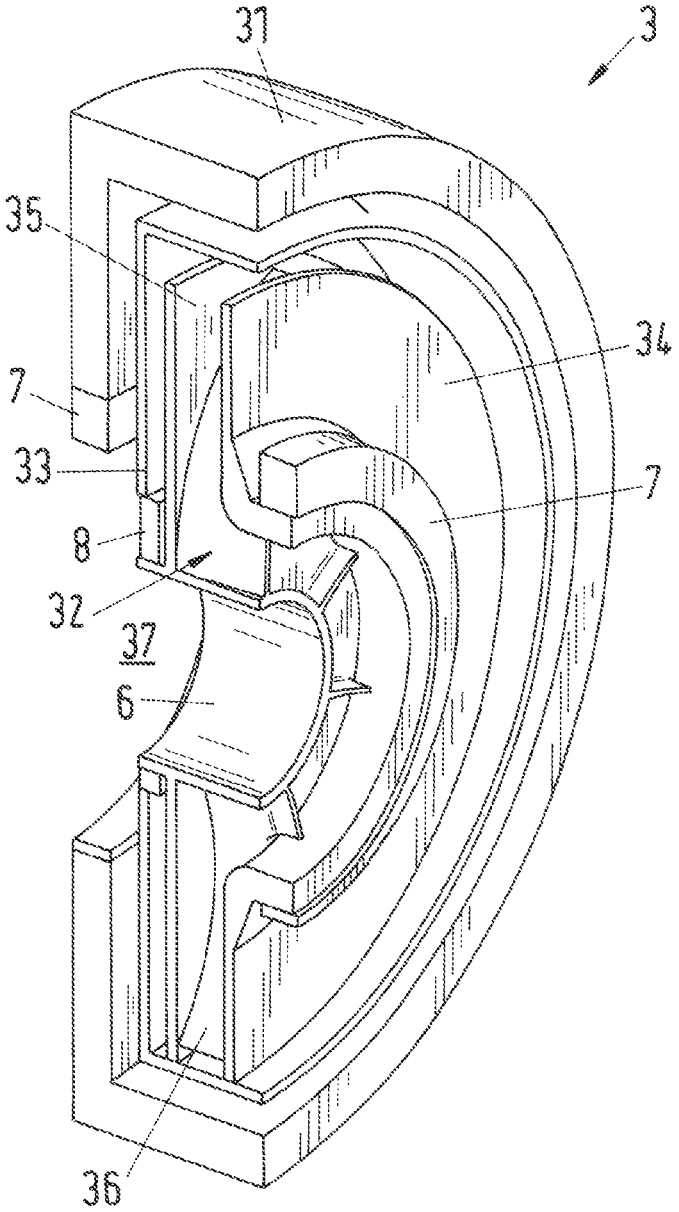
FIG. 2 is a perspective sectional view of a pump stage of the embodiment from FIG. 1.

FIG. 1 shows in a schematic lateral view an embodiment of a multi-stage horizontal centrifugal pump according to the invention which is designated as a whole by the reference numeral 1. In FIG. 1 some parts of the pump 1 are illustrated in a in cross section. FIG. 2 shows some parts of the pump 1 in an enlarged sectional view.

Such multi-stage pumps are used for example in industrial energy generation, e.g. as feed pumps or boiler feed pumps in which the fluid to be conveyed is water which is transported from the pump 1 to a steam generator. Such pumps are also used in the oil and gas industry for pumping water, for example as injection pumps, or also for extracting oil or other hydrocarbons.

In the embodiment shown in FIG. 1, the pump 1 comprises an outer barrel casing 2 having an inlet 4, an outlet 5 as well as optionally an intermediate outlet 51 for the fluid to be conveyed. The latter one will be described in more detail below.

The pump 1 comprises a rotatable shaft 6 which extends in the centre through the pump 1 and which can be set in rotation by a power unit such as an electric motor which is not shown here. The pump 1 has a central axis A which extends through the centre of the chamber provided for the shaft 6 within the pump 1 and which constitutes the target rotation axis about which the shaft 6 should rotate. If the shaft 6 installed in the pump 1 had no deflection, the central axis A would be congruent with the longitudinal axis of the shaft. In the following, when reference is made to the axial direction, this always refers to the direction of the central axis A of the pump 1. When reference is made to the radial direction, this refers then to a direction which is perpendicular to the axial direction.

In a manner known per se a plurality of pump stages 3—in this case for example eight—are disposed in the barrel casing 2, which are arranged consecutively one after another with respect to the axial direction. FIG. 1 shows the pump 1 in its normal position, i.e. in the horizontal arrangement where the central axis A extends horizontally or parallel to the subsurface.

Figure 3:
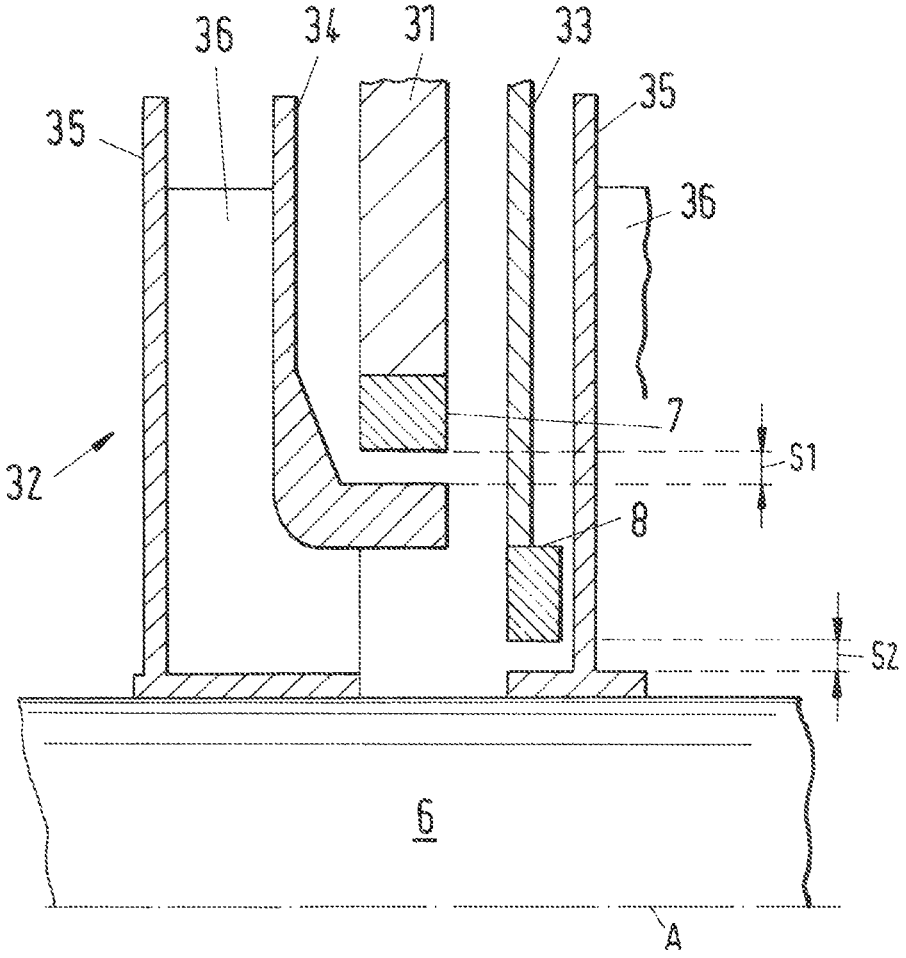
FIG. 3 is an enlarged sectional view illustrating the clearance between a first and a second wear ring.

For a better understanding FIG. 2 shows in an enlarged view a perspective sectional view of one of the pump stages 3 (see also FIG. 3).

Each pump stage 3 comprises in a manner known per se an impeller 32, a stage casing 31, as well as on the high pressure side, a partition wall 33 which separates the pump stage 3 from the next pump stage 3. Each impeller 32 is shaped as a closed impeller 32, i.e. it comprises a front cover plate 34, a rear cover plate 35 as well as a plurality of blades 36 arranged between the cover plates 34, 35 for conveying the fluid. Each stage casing 31 comprises a stationary impeller opening 37 for receiving the front cover plate 34 of one of the impellers 32. The partition wall 33 is also stationary with respect to the stage casing 31 and serves to transport the fluid conveyed by the impeller 32 to the inlet, i.e. to the impeller 32 of the next pump stage 3. For this purpose the partition wall 33 comprises a stationary diffuser which is not illustrated in more detail in the drawings.

The impellers 32 of all pump stages 3 are connected in a rotatably fixed manner to the shaft 6 such that the impellers 32 rotate together with the shaft 6.

Within the scope of this application the term "rotor" means the totality of the components of the pump 1 that rotate in the operating state of the pump 1. The rotor of the pump 1 thus comprises the shaft 6 and all impellers 32 arranged on it as well as possibly further components of the pump 1 rotating together with the shaft 6 or being connected in a rotatably fixed manner to the shaft 6. Within the scope of this application the term "stator" of the pump means the totality of the stationary, i.e. non-rotating, components of the pump. Thus the stator comprises in particular all stage casings 31 and all partition walls 32.

As it is especially shown in FIG. 1, all pump stages 3 and all stage casings 31 are arranged parallel to each other in such a manner that the areas enclosed by each of the impeller openings 37 are perpendicular to the central axis A.

When the pump 1 is in operation, the fluid to be conveyed, such as water, which enters through the inlet 4 of the pump 1, is transported from the first impeller 32—this is the rightmost impeller 32 illustrated in FIG. 1—to the annulus between the partition wall 33 and the stage casing 31 and from there it is conducted radially inwardly between the partition wall 33 and the stage casing 31 before reaching the impeller 32 of the adjacent pump stage 31. This process continues through all pump stages 3 up to the final stage—this is the leftmost one shown in FIG. 1—conducting the fluid then from the outlet of the final stage to the outlet 5 of the pump 1.

As is usual, two wear rings are provided in each pump stage 3 to seal the respective pump stage 3 against its adjacent pump stages 3 or against the inlet 4 or the outlet 5. A first wear ring 7 is fitted into the impeller opening 37 of the stage casing 31 in such a manner that the stationary impeller opening is radially inwardly confined by the first wear ring 7 which is connected in a fixed manner to the stage casing 3 and consequently is stationary. Thus the first wear ring 7 surrounds the front cover plate 34 of one of the impellers 32. A second wear ring 8 is provided radially inwardly at the stationary partition wall 33 and encompasses the shaft 6, i.e. the stationary partition wall 33 is radially inwardly confined by the second wear ring 8 which is arranged with respect to the radial direction between the partition wall 33 and the shaft 6. The second wear ring 8 is connected in a fixed manner to the partition wall 33 and consequently is also stationary.

As already mentioned, both wear rings 7, 8 serve to seal the pump stages 3 along the shaft 6. Each of the wear rings 7, 8, however, surrounds the rotor with a clearance in such a manner that an annular gap is formed between the radially outer surface of the rotor and the radially inner surface of the wear ring 7, 8, through which gap the leakage flows in the opposite direction to the general conveying direction of the fluid. On the one hand this leakage flow is desirable, in particular to stabilize the rotor in a hydrodynamic manner, but on the other hand it should not be too big, as the leakage flow decreases the efficiency of the pump. Furthermore, during the normal operating state of the pump 1 any direct physical contact between the rotor (shaft 6 or impeller 32) and one of the wear rings 7, 8 should be avoided.

As the clearance between the rotor and the wear rings 7, 8 is typically very small, it can be recognized neither in FIG. 1 nor in FIG. 2. Therefore FIG. 3 shows an enlarged sectional view for illustrating the clearance of a first and a second wear ring 7 or 8.

As it can be seen in FIG. 3, there is a clearance S1 between the radially inner surface of the first wear ring 7 and the radially outer surface of the front cover plate 34 of the impeller 32, such clearance leading to the formation of an annular gap between the first wear ring 7 and the front cover plate 34. In the same way there is a clearance S2 between the radially inner surface of the second wear ring 8 and the radially outer surface of the shaft 6, such clearance leading to the formation of an annular gap between the second wear ring 8 and the shaft 6. The clearance S1 can—but does not necessarily have to—be as big as the clearance S2.

As already mentioned, in the case of multi-stage horizontal pumps 1, in particular those where the shaft 6 is very long, the mass of the rotor leads to a significant deflection of the shaft 6 or the rotor. Such deflection is illustrated in a very schematic way in FIG. 6 by a sag line B. The sag line B of the shaft 6 constitutes the centerline of the shaft 6, when the shaft 6 including the impellers 32 connected in a rotatably fixed manner to it and other components, thus the rotor, is installed in the pump 1, i.e. when the shaft 6 is arranged in its bearings and in particular radial bearings which are positioned on the outside in the region of both ends of the shaft 6, but which are not shown in more detail.

Figure 6:
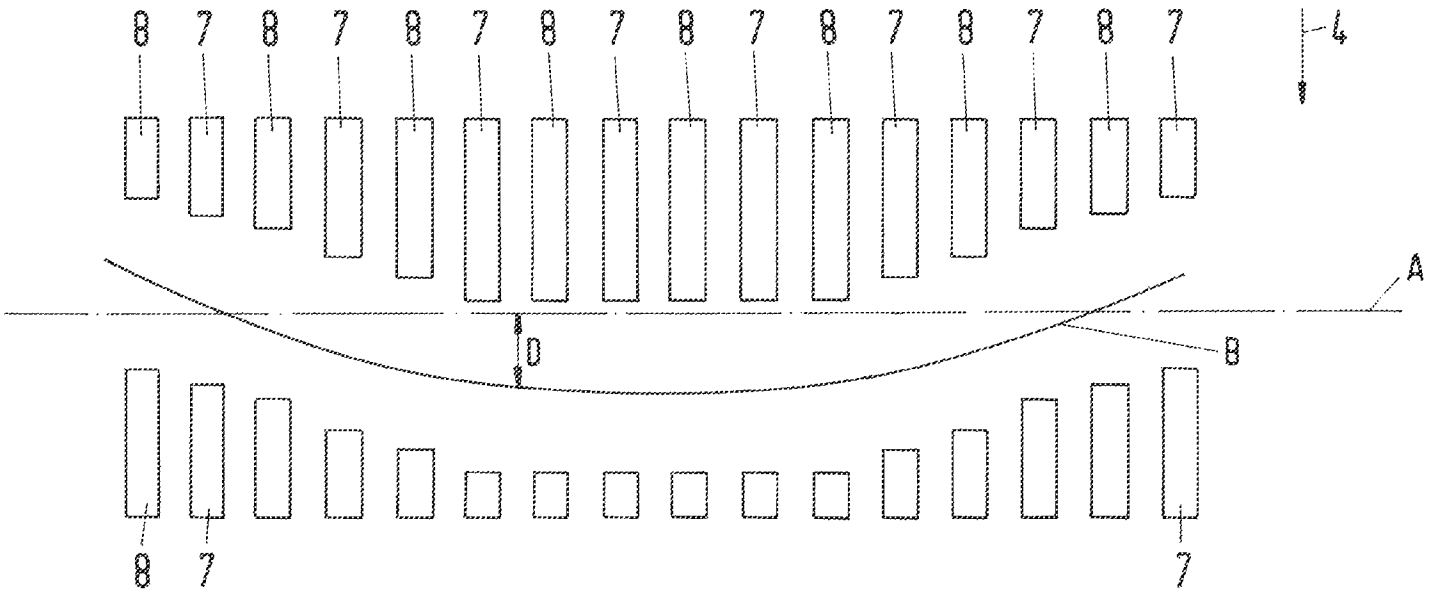
FIG. 6 is a schematic view of the sag line of the shaft at a nominal speed of the pump.

If there was no deflection, the sag line B would be positioned exactly on the central axis A of the pump 1. The term deflection D of the shaft 6 means the distance of the sag line B from the central axis A. In the case of a horizontal pump 1, due to the direction of the gravitational force, the sag line B constitutes always a convex curve. The deflection D reaches its maximum approximately in the centre of the pump 1, as it is illustrated in FIG. 6. Depending on the length of the shaft 6 and the mass of the impellers 32, the maximum deflection D can be a few tenths of a millimetre, for example 0.2 to 0.5 mm or more.

Figure 4:
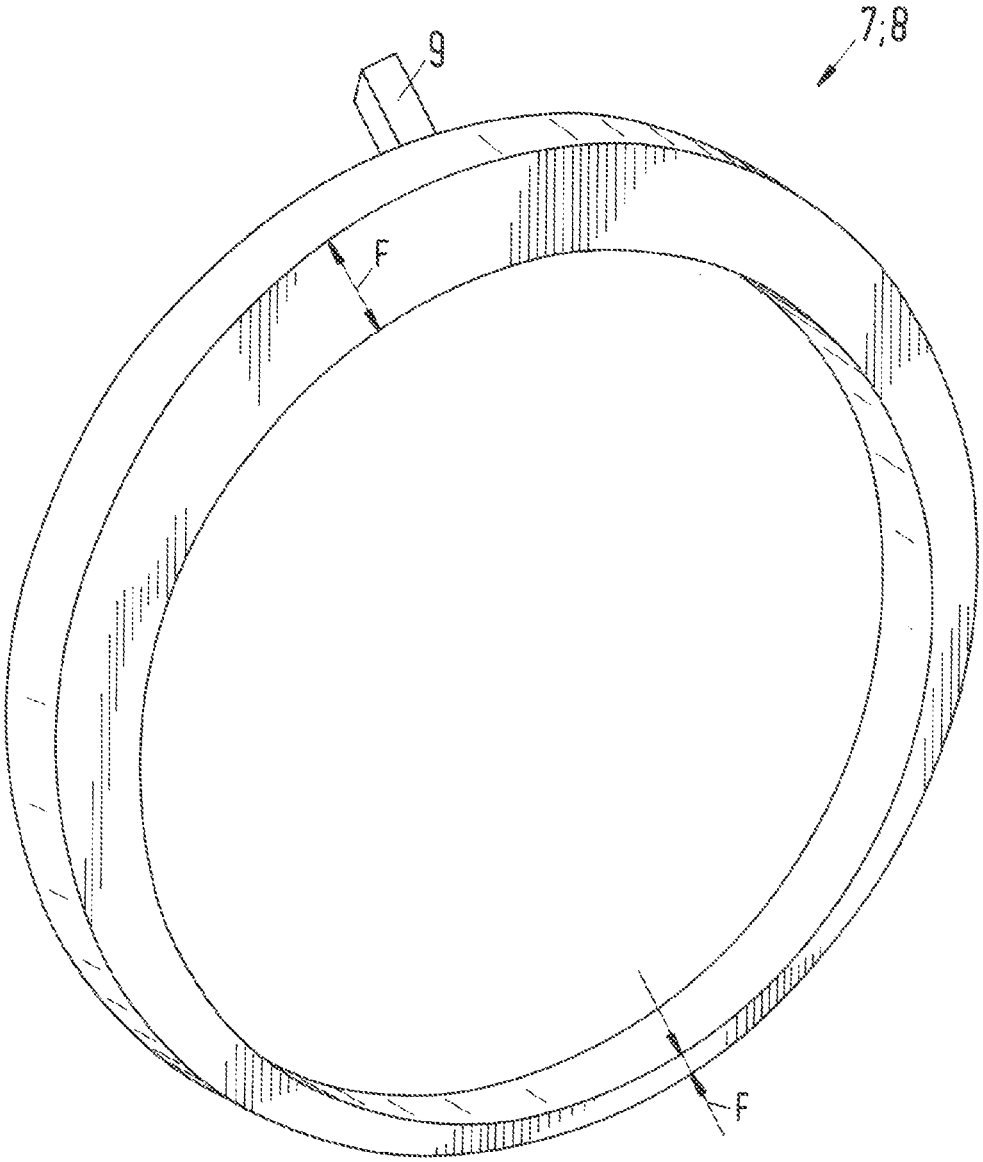
FIG. 4 is a perspective view of an embodiment of a wear ring.
Figure 5:
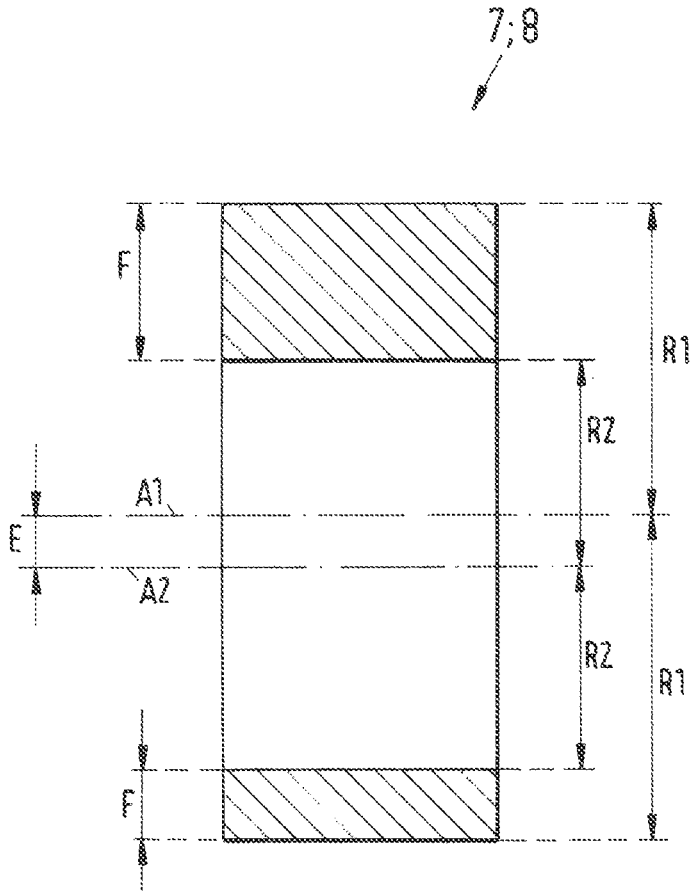
FIG. 5 is a cross sectional through the wear ring from FIG. 4 in the axial direction.

In order to compensate the problems resulting from the deflection D of the shaft 6, it is suggested according to the invention that at least one of the first or the second wear rings 7 or 8 is eccentrically designed. FIG. 4 shows an embodiment of such an eccentrically designed wear ring 7 or 8 in a perspective view. FIG. 5 shows a section through the wear ring 7, 8 from FIG. 4, wherein the section is performed in the axial direction, i.e. in the same way as in FIG. 3. FIG. 5 illustrates additionally the term of the eccentric design or eccentricity.

The term "eccentric design" means that the radially outer surface of the wear ring 7, 8 is centred about a different axis than its radially inner surface. This is illustrated in FIG. 5 for the simple embodiment of the wear ring 7, 8 where the cross-sectional area of the wear ring 7 or 8 is rectangular. In this embodiment each surface of the wear ring 7 or 8, i.e. the radially outer surface as well as the radially inner surface, constitutes a cylindrical barrel surface. The radially outer surface has a radius R1 and the radially inner surface has a radius R2, with R2 being, of course, smaller than R1. The radially outer surface is centred about a first axis A1, i.e. in this case A1 is identical to the cylinder axis of the radially outer surface. The radially inner surface is centred about a second axis A2, i.e. in this case A2 is identical to the cylinder axis of the radially inner surface. The axes A1 and A2 are parallel to each other, but they are not congruent. This design of the axes A1 and A2 being not congruent is referred to as eccentric. The eccentricity E which is given by the distance between the two axes A1 and A2 is determined to be a measure for the intensity of the eccentric design.

Depending on the maximum deflection D of the shaft 6, the eccentricity E can be in the range of up to a few tenths of a millimeter. Thanks to the modern processing methods usually used today it is no problem to produce such eccentricities E in a wear ring 7 or 8 with sufficient accuracy.

Due to the eccentric design the radial width F of the wear ring 7 or 8 varies along its circumference, i.e. there is a maximum radial width F and a minimum radial width F, with the radial width F being the extension of the wear ring 7 or 8 in the radial direction.

Due to the variation in the radial width F the wear ring 7 or 8 has to be fastened at the stage casing 31 and the partition wall 33, respectively, in the correct angular orientation. As the deflection D of the shaft 6 occurs always downwards with respect to the normal position, the wear ring 7 or 8 is inserted in such orientation positioning the wear ring with its maximum radial width F perpendicularly above the central axis A or with its minimum radial width F perpendicularly below the central axis A.

In order to realize the correct angular orientation of the wear ring 7 or 8 in a simpler way, it is advantageous, if each eccentric wear ring 7 or 8 comprises a positioning means 9. This positioning means 9 (see FIG. 4) can, for example, be a pin 9 protruding in the axial direction from the ring and engaging during the installation into a corresponding hole (not shown here) provided in the respective stage casing 31 or the respective partition wall 33. Of course, it is also possible to use other positioning means 9, such as a projection or recess at the wear ring 7 or 8, which interacts in an interlocking manner with a projection or recess provided in the stage casing 31 or in the partition wall 33, or visually recognizable markings such as notches, lines or arrows.

For reasons of assembly the positioning means 9—as shown in FIG. 4—is preferably provided where the respective wear ring 7 or 8 has its maximum radial width F.

It is self-explanatory that the rectangular cross-sectional area of the wear ring 7 or 8 illustrated in FIG. 5 is only to be taken as example. Of course, the wear rings 7 or 8 can have other and more complex cross-sectional areas, in particular those used in the prior art for wear rings in centrifugal pumps. The cross-sectional area of the wear ring 7 or 8 can, for example, have an L-shaped or trapezoidal form, it can comprise borderlines extending at an oblique angle or acute angle to each other. Furthermore, rounding offs or cants may be provided. The man skilled in the art knows many possibilities for forming these cross-sectional areas.

Furthermore, it is evident that the first wear ring 7 usually has a different geometrical configuration than the second wear ring 8, even if, in principle, the geometrical configurations can be identical.

The radially inner surface of each wear ring 7 or 8 is usually a cylindrical barrel surface having a radius R2 (see FIG. 5). Typically, the radius R2 of the first wear rings 7 is different from the radius R2 of the second wear rings 8. The radius R2 of the second wear rings 8 is usually smaller than those of the first wear rings 7.

As regards the material used for the production of the wear rings 7, 8, the man skilled in the art knows many possibilities. One example of this are martensitic premium steels or stainless steels.

The at least one wear ring 7 or 8 having an eccentric design according to the invention is provided where the deflection D of the shaft 6 reaches its maximum. The eccentricity E of this wear ring is preferably measured such that the rotating shaft 6 or the rotating cover plate 34 of the impeller 32 is at least approximately centred with respect to the radially inner surface of the eccentric wear ring 7 or 8; i.e. the eccentricity E is selected such that it is at least approximately adjusted to the deflection D of the rotating shaft 6 at the place of this wear ring 7 or 8. As a result, the rotating shaft 6 or the rotating cover plate 34 in that eccentrically designed wear ring 7 or 8 is at least approximately centred with respect to the second axis A2 (see FIG. 5).

This eccentrically designed wear ring 7 or 8 is then fastened at the stage casing 31 and the partition wall 33, respectively, preferably by using the positioning means 9, such that its region having the maximum radial width F is arranged perpendicularly above the central axis A. If the rotor rotates then, it is essentially centred in that wear ring 7 or 8, i.e. the rotor is—as described above—at least approximately centred with respect to the axis A2. This means that the clearance S1 or S2 (see FIG. 3) is at least approximately constant within this wear ring 7 or 8 in the circumferential direction of the rotor. As a consequence, the rotor can rotate without contacting the wear ring 7 or 8.

If the pump 1 is then turned off in such a manner that the rotor stops, the deflection D usually increases, in particular also in this region where the deflection D reaches its maximum. Due to the clearance S1 or S2 between the rotor and the eccentrically designed wear ring 7 or 8 there is still enough space below the rotor in the wear ring 7 or 8 permitting the rotor to avoid direct physical contact with the wear ring 7 or 8 despite the increased deflection D of the rotor. This means that the rotor or shaft 6, even during standstill, is free in the sense that the rotor or shaft 6 does not rest upon the wear ring 7 or 8. This has particularly the advantage that it is possible to manually rotate the rotor during standstill of the pump 1, which constitutes an enormous advantage in particular for maintenance and assembly work.

Furthermore, the fact that there is no contact is also advantageous for starting and turning off the pump 1, as the rotor does not grind against the wear ring 7 or 8. Consequently, on the one hand it is not necessary to provide the wear ring 7 or 8 with a coating, and on the other hand the useful life of the rotor increases, as its components do not mechanically grind against the wear ring 7 or 8.

For most applications it is advantageous, if a plurality of the first as well as of the second wear rings 7 or 8 is eccentrically designed. In this respect the eccentricity E of an individual wear ring 7 or 8 is adjusted to the deflection D of the shaft 6 at its individual position.

Therefore, as regards the sag line B illustrated by way of example in FIG. 6, the eccentricity E of the wear rings 7 or 8 preferably increases from both ends of the shaft 6 towards the centre of the pump 1.

It is particularly preferred that the eccentricity E of the first and second wear rings is adjusted over the whole length of the part of the rotor enclosed by the wear rings 7, 8 to the sag line B of the shaft 6, as it will be explained in the following on the basis of FIGS. 6 and 7.

The sag line B of the shaft arranged in a pump 1 can for example be determined on the basis of empirical or historical data. It is, of course, also possible to determine the sag line B by measurement or calculations such as simulations.

If the sag line B is at least approximately known for a certain pump 1, it is also possible to determine the regions of the rotor where the deflection D of the shaft 6 is such that eccentrically designed wear rings 7 or 8 are advantageous there.

Then it is determined which eccentricity E each individual wear ring 7 or 8 should advantageously comprise. For this purpose there are two particularly preferred criteria. Firstly, the eccentricity E of the wear ring 7 or 8 is measured such that during standstill of the shaft 6 none of the wear rings 7 or 8 contacts the shaft 6 such that the shaft 6 during standstill does not rest upon any of the wear rings 7 or 8 and therefore is freely rotatable, in particular by hand. The second criteria is to measure the eccentricity for each individual wear ring 7 or 8 such that the sag line B of the shaft 6 extends at a typical rotational speed of the pump 1, when operating, such as the nominal speed, essentially or at least approximately centered with respect to all wear rings 7 or 8. That means, as already described above in the case of an individual wear ring 7 or 8, one intends to centre at least approximately for each individual wear ring 7 or 8 the shaft 6 with respect to the axis A2 of the radially inner surface of that wear ring 7 or 8.

Figure 7:
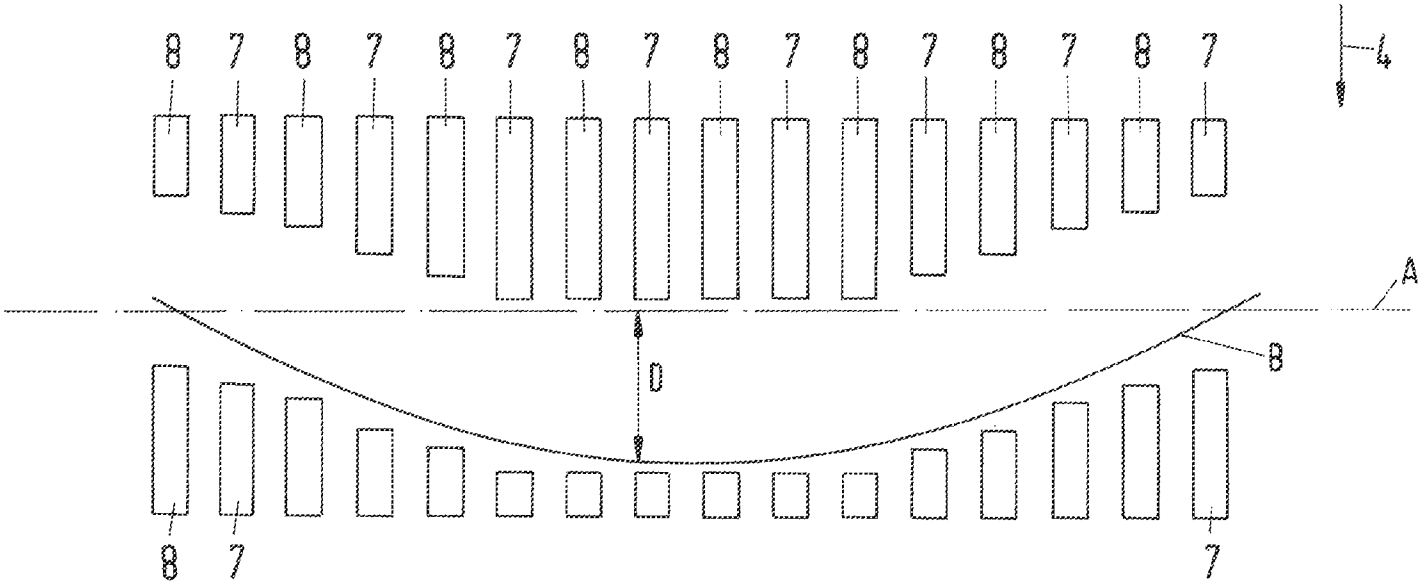
FIG. 7 is a schematic view of the sag line of the shaft during standstill of the pump.

FIGS. 6 and 7 show in a schematic view this adjustment of the eccentricity E to the sag line B of the shaft 6. For a better understanding the rotor is represented in each of the FIGS. 6 and 7 only by the sag line B of the shaft 6; i.e. FIG. 6 and FIG. 7 do not take into account the finite extent of the rotor in the radial direction. Thus, the radial extension of the rotor is not shown, but the sag line B represents symbolically the rotor or the shaft 6 with the impellers 32.

With reference to the embodiment shown in FIG. 1, FIG. 6 shows the situation of the shaft 6 rotating at a typical rotational speed, such as the nominal speed of the pump 1. It can be recognized that the eccentricity E of the first as well as of the second wear rings 7 or 8 increases first from the left end of the illustration to approximately the centre of the pump 1, then decreasing towards the right end of the pump. It can also be recognized that the sag line B is at least approximately centred with respect to the radially inner surface of all wear rings 7 or 8. As a consequence, also the clearance S1 or S2 (see FIG. 5) is at least approximately constant for each of the wear rings 7 or 8 in the circumferential direction.

With reference to the embodiment shown in FIG. 1, FIG. 7 shows the situation when the shaft 6 is not in motion. It can be recognized that the deflection D of the shaft 6 and in particular the maximum of the deflection D has increased, but that the rotor or the shaft 6—represented by the sag line B—is not in direct physical contact with the wear rings 7 or 8, i.e. it is freely rotatable with respect to the wear rings.

The adjustment of the eccentricity E of the wear rings 7 or 8 to the sag line B which has been described above is advantageous in particular with regard to temperature changes, especially rapid or temporary temperature changes. As the rotor or the shaft 6, when operating, is always in an optimal position with respect to the stage casing 31 or the partition walls 32, or, more generally, with respect to the stator of the pump 1, larger temperature changes, i.e. larger temporal temperature gradients are possible without any risk to the rotor to come into direct physical contact with the wear rings 7 or 8 and without the need to provide other measures such as preheating the pump 1.

A further advantage resulting from the adjustment of the eccentricity E of the wear rings 7 or 8 to the sag line B of the shaft 6 is the possibility to reduce the clearance S1 or S2 (see FIG. 3) in many applications due to the optimized positioning of the rotor with respect to the stator, leading to an increase in efficiency or effectiveness of the pump 1.

A particular advantage of the configuration according to the invention is the possibility to realize the adjustment of the stator of the pump 1, i.e. in particular of the stage casings 31, the partition walls 32 and the wear rings 7, 8, to the sag line B of the shaft 6 only by the wear rings 7 and 8 which can be manufactured as wear parts in an especially cost-effective manner. No further modifications or constructional measures are necessary for this adjustment. Neither one nor more stage casings 31 have to be arranged in a tilted position, nor other components such as the stage casing 31 nor the partitions walls 32 have to be eccentrically designed. All components except for the wear rings 7, 8, i.e. in particular also the stage casings 31, can be designed and arranged centrically or concentrically to the central axis of the pump 1. This constitutes an enormous advantage for the construction and the production.

As regards the configuration as pump 1 with barrel casing 2, there is the further constructional advantage that it is not necessary to tilt the inlet 4 of the pump 1 with respect to the central axis A, but—as usual—it can be designed and arranged such that the axis C of the inlet 4 (see FIG. 1) is perpendicular to the central axis A.

A further advantage is that due to the parallel alignment of all pump stages 3, in particular of all stage casings 31 in pumps 1 with barrel casing 2, as it is the case in this embodiment, reliable seals can be provided between the outer surfaces of the stage casings 31 and the barrel casing 2. As a consequence, it is possible to provide different pressure chambers in the barrel casing 2, which are sealed against each other and in which the fluid to be conveyed such as water is available at different pressures.

This has the advantage that the intermediate outlet 51 can be provided at the barrel casing 2, such intermediate outlet permitting to discharge the fluid at an intermediate pressure from the pump, wherein the intermediate pressure is smaller than the pumping pressure of the fluid at the outlet 5 of the pump 1 and greater than the suction pressure at the inlet 4 of the pump 1. In industrial energy generation, for example, it is often desirable that the water as medium to be conveyed is available at different pressures.

As the adjustment of the pump 1 to the sag line B of the shaft 6 can be realized only by means of the wear rings 7, 8 and without having to take other constructional measures, the invention is also particularly suitable for maintaining, repairing and overhauling pumps which are already in operation and in particular for such pumps which have not yet been adjusted or not sufficiently been adjusted to the sag line B of the shaft 6.

In the method according to the invention, in the same sense and way as previously described, at least one of the first and/or of the second wear rings is replaced in each case by an eccentrically designed wear ring 7 or 8.

Also with regard to the method it is preferred, if the eccentricity E of the wear rings 7 and 8 is adjusted to the sag line B of the shaft.

It is obvious that the invention is not limited to the pump type described in the embodiment according to FIG. 1, but is suitable for all multi-stage horizontal centrifugal pumps. The pump 1 can, for example, also be shaped as ring section pump, in which the totality of stage casings 31 form the outer pump casing, i.e. no additional barrel casing 2 is provided. The invention is particularly suitable also for those pumps in which the impellers 32 are arranged in a so-called back-to-back arrangement. In the case of this arrangement the multi-stage pump comprises two groups of impellers, namely a first group of impellers which are oriented with their inlet (their suction side) towards the one end of the pump, and a second group of impellers which are oriented with their inlet (their suction side) towards the other end of the pump. Thus, these two groups are arranged back to back to each other. It is obvious that in the case of a two-stage pump each of the two groups comprises only one impeller. These two impellers are then arranged such that their suction sides are turned away from each other.

The invention claimed is:

1. A multiple-stage horizontal centrifugal pump for conveying a fluid, comprising:

a rotor comprising a rotatably arranged shaft and a plurality of impellers for conveying the fluid, each impeller of the plurality of impellers being arranged in a rotatably fixed manner on the shaft;

a stator comprising a plurality of stage casings arranged consecutively one after another with respect to an axial direction determined by a central axis, the stator encompassing the rotor, and each stage casing of the plurality of stage casings being configured and arranged centrically with respect to the central axis;

a plurality of wear rings disposed between the rotor and the stator, each wear ring of the plurality of wear rings being fixed with respect to the stator, and surrounding the rotor with a clearance, at least one wear ring of the plurality of wear rings is designed eccentrically and unitarily; and wherein each stage casing of the plurality of stage casings is separate from each other stage casing of the plurality of stage casings.

2. The multiple-stage horizontal centrifugal pump according to claim 1, wherein at least two wear rings of the plurality of wear rings is designed eccentrically.

3. The multiple-stage horizontal centrifugal pump according to claim 1, wherein the least two wear rings of the plurality of wear rings have an eccentricity which increases towards a center of the pump.

4. The multiple-stage horizontal centrifugal pump according to claim 3, wherein the eccentricity of the least two wear rings is adjusted to a sag line of the shaft.

5. The multiple-stage horizontal centrifugal pump according to claim 3, wherein the eccentricity of the at least two wear rings is such that during a standstill of the shaft none of the wear rings is in contact with the shaft or the impellers.

6. The multiple-stage horizontal centrifugal pump according to claim 3, wherein the eccentricity of the at least two wear rings is such that the sag line of the shaft extends essentially centered with respect to the plurality of wear rings at a nominal speed of the pump.

7. The multiple-stage horizontal centrifugal pump according to claim 1, further comprising a plurality of pump stages arranged consecutively one after another with respect to the axial direction, each pump stage comprising an impeller of the plurality of impellers for pumping the fluid, including a front cover plate, a stage casing of the plurality of stage casings and a partition wall for conducting the fluid to the adjacent pump stage, the partition wall being stationary with respect to the stage casing, the stage casing for each pump stage having a stationary impeller opening to receive the front cover plate of a respective impeller, each stationary impeller opening being radially inwardly confined by a first wear ring of the plurality of wear rings, which surrounds the front cover plate of the impeller with the clearance, and each stationary partition wall being radially inwardly confined by a second wear ring of the plurality of wear rings, which surrounds the shaft with another clearance.

8. The multiple-stage horizontal centrifugal pump according to claim 1, wherein the at least one wear ring of the plurality of wear rings comprises a positioning device configured to position the at least one wear ring at a predefined angular orientation in a stage casing or a partition wall.

9. The multiple-stage horizontal centrifugal pump according to claim 8, wherein the positioning device is disposed on the at least one wear ring at a maximum width of the at least one wear ring in a radial direction.

10. The multiple-stage horizontal centrifugal pump according to claim 1, wherein each stage casing of the plurality of stage casings is arranged in a barrel casing.

11. The multiple-stage horizontal centrifugal pump according to claim 1, further comprising an inlet, an outlet, and an intermediate outlet configured to convey the fluid, the intermediate outlet being designed and arranged such that at least a part of the fluid is capable of being discharged at an intermediate pressure through the intermediate outlet, the intermediate pressure being greater than a pressure of the fluid at the inlet (4) of the pump and less than the pressure of the fluid at the outlet of the pump.

12. A method for repairing or overhauling a multi-stage horizontal centrifugal pump for conveying a fluid having a rotor comprising a rotatably arranged shaft and a plurality of impellers for conveying the fluid, each impeller of the plurality of impellers arranged in a rotatably fixed manner on the shaft, and having a stator comprising a plurality of stage casings arranged consecutively one after another with respect to an axial direction determined by a central axis, the stator encompassing the rotor, and each stage casing of the plurality of stage casings designed and arranged centrically with respect to the central axis, and a plurality of wear rings disposed between the rotor and the stator, each wear ring of the plurality of wear rings fixed with respect to the stator, and surrounding the rotor with a clearance, the method comprising;

replacing at least one wear ring of the plurality of wear rings with an eccentrically and unitarily designed wear ring; and wherein each stage casing of the plurality of stage casings is separate from each other stage casing of the plurality of stage casings.

13. The method according to claim 12, further comprising adjusting the eccentricity of the at least one wear ring of the plurality of wear rings to a sag line of the shaft.

14. The method according to claim 12, further comprising measuring the eccentricity of the at least one wear ring of the plurality of wear rings so that during standstill of the shaft none of the plurality of wear rings contacts the shaft.

15. The method according to claim 12, further comprising measuring the eccentricity of the at least one wear ring of the plurality of wear rings so that the sag line of the shaft extends essentially centered with respect to each wear ring of the plurality of wear rings at a nominal speed of the pump.

* * * * *